US005711352A

United States Patent [19]

Bucher

[11] Patent Number: 5,711,352

[45] Date of Patent: Jan. 27, 1998

[54] MOUNTING ARRANGEMENT FOR LINEARLY DRIVEN HEALD FRAMES

[75] Inventor: Robert Bucher, Frick, Switzerland

[73] Assignee: Sulzer Rueti AG, Rueti, Switzerland

[21] Appl. No.: 630,867

[22] Filed: Mar. 29, 1996

[30] Foreign Application Priority Data

Mar. 14, 1996 [GB] United Kingdom ..... 96810163

[51] Int. Cl.[6] ..... D03C 5/06; D03C 13/00

[52] U.S. Cl. ..... 139/455; 139/83

[58] Field of Search ..... 139/455, 83, 84, 139/55.1, 57

[56] References Cited

U.S. PATENT DOCUMENTS

| | | | |
|---|---|---|---|
| 4,572,247 | 2/1986 | Speich, Jr. | 139/455 |
| 5,069,256 | 12/1991 | Goodman, Jr. | 139/83 |
| 5,273,079 | 12/1993 | Beyaert et al. | 139/55.1 |

*Primary Examiner*—Andy Falik

*Attorney, Agent, or Firm*—Townsend and Towsnend and Crew LLP

[57] ABSTRACT

Apparatus containing a heald frame consisting of two heddle carrying rails and a plurality of linear drives with armature parts that are connected to the heddle carrying rails in such a way that the heald frame is guided free of play. Devices are utilized for connecting the armature parts and the heddle carrying rails. The devices comprise a plate that is secured to the heddle carrying rail and a holder that is secured to the armature part. The plate is provided with a slot, and the holder has a pin that engages the slot. The slot is dimensioned such that a compensation of the play is possible at the interface between the armature part and the heald frame in order to prevent jamming of the armature parts and the heald frame, while the slot enables a compensation in the direction transverse to the working direction of the heald frame.

10 Claims, 3 Drawing Sheets

MOUNTING ARRANGEMENT FOR LINEARLY DRIVEN HEALD FRAMES

BACKGROUND OF THE INVENTION

1. Technical Field

The invention relates to an apparatus for forming a weaving shed and to a weaving machine with an apparatus for forming a weaving shed.

2. Description of the Prior Art

An apparatus of this kind is known from EP-B-0 353 005. One embodiment relates to an individual heddle control and another to a heald frame control. The embodiment for the heald frame control contains two electronically controlled electrical linear drives and a heald frame with heddles and frame which is connected at one longitudinal side to the armature parts of the linear drives and guided at the broad sides.

In weaving machines for manufacturing fabrics with a width of up to two meters a heald frame is, as a rule, connected to a shaft drive at three positions. For this reason the heald frame comprises a rectangular shaft frame and two heddle carrying rails which are inserted into the shaft frame. The shaft frame must comprise straight components not susceptible to bending in correspondence with the weaving width. Despite the simplification in the design and the selection of lightweight material the mass of a heald frame is high. Narrow limits are however set for a reduction of this mass. A compensation for the mass after movement has already been largely exhausted through the reduction of the stroke height.

Due to this situation, the prior art apparatus suffers in that the energy consumption and the costs of such linear drives are high and further in that a considerable frictional loss arises through the shaft frame guide. As a result of the bending of the sections of the shaft frame a heddle clearance must be provided which causes noise.

SUMMARY OF THE INVENTION

The invention is based on the object of providing an apparatus for forming a weaving shed in which the heald frame is of low mass and the heald frame is freely movable and guided without play.

This object is satisfied in accordance with the invention, which provides apparatus for forming a weaving shed comprising two heddle carrying rails and a plurality of heddles for receiving and moving warp threads. The heddles are arranged between the heddle carrying rails to form a heald frame. A plurality of linear drives each having an armature part are mounted to one of the heddle carrying rails via the armature parts. Connection means for connecting the armature parts to the heddle carrying rails are also provided. A connection means comprises a first part connected to one of the armatures and a second part connected to one of the rails with the connection means being configured such that the first and second parts are movable relative to one another in a direction transverse to a working direction the heald frame.

The advantages which can be achieved by the invention include in the fact that the design of the heald frame enables a small shaft pitch and that through a reduction of the shaft pitch a reduction of the maximum required stroke height is achieved, in particular with a high shaft number.

In order to facilitate the installation of the apparatus a frame can be provided to which the linear drives are secured and which can be inserted into a weaving machine. In this way a change of article can be facilitated. If two linear motors are combined into a constructional unit then the pitch of the heddle carrying rails can be further reduced.

DETAILED DESCRIPTION OF THE PREFERRED EMBODIMENTS

Figure 1:
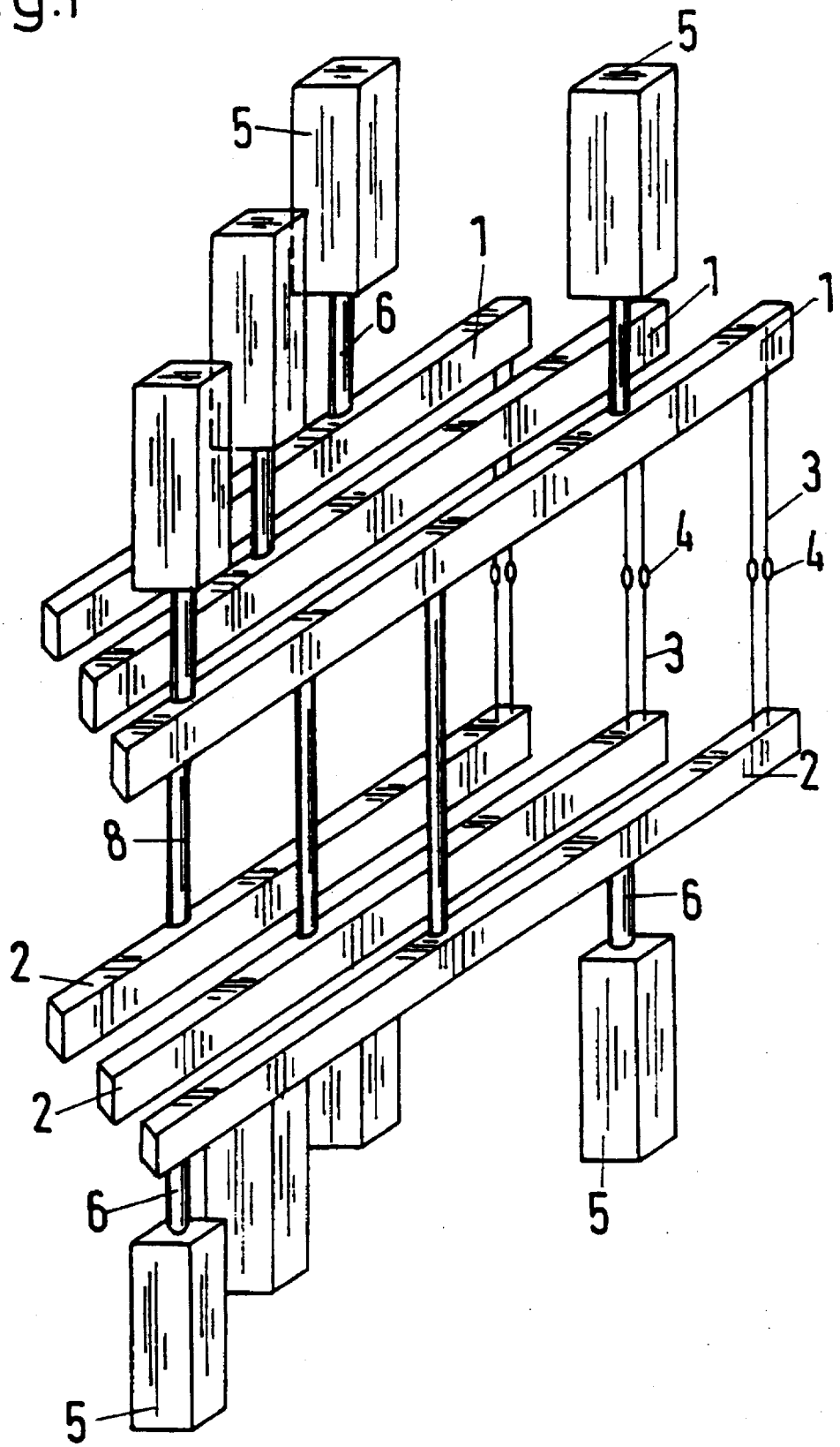
FIG. 1 is a perspective view of part of a set of shafts in accordance with the invention in a spatial illustration.

Reference is made to FIGS. 1 to 4. As shown in FIG. 1, the heald frame has an upper and lower heddle carrying rail 1 and 2, a plurality of heddles 3 with heddle eyes 4 which are suspended in the rails and a plurality of linear motors 5 with armature parts 6 which are connected to the heddle carrying rails 1, 2, with the points of connection being spaced apart equidistantly, respectively.

As FIG. 1 further shows for one set of shafts the linear motors 4 are arranged such that they are displaced relative to the neighboring heddle carrying rails. The reason for this arrangement is that the spacing between the heald frames can be selected to be as small as possible. The heddle carrying rail is a customary design, i.e. a so-called norm bar. The linear drives 5 are arranged in a fixed position and hold the heald frame in an initial position in which the heddle eyes 4 of all heald frames lie on a line or in a plane.

Figure 2:
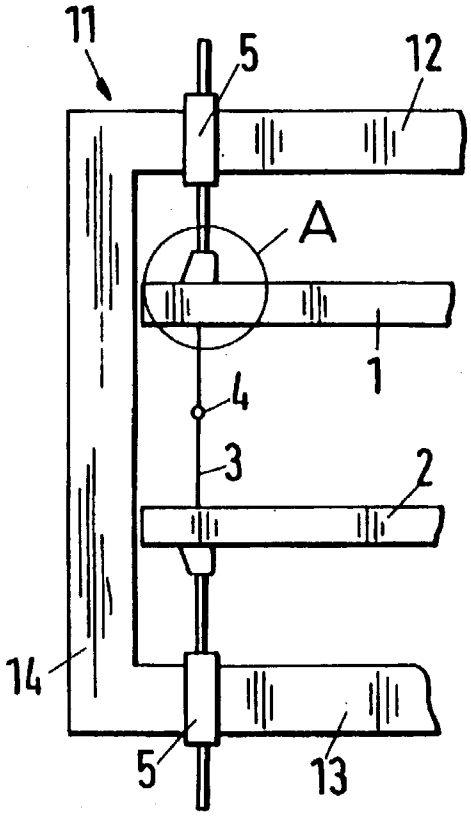
FIG. 2 is an elevation view of a portion of a first embodiment of a holding arrangement for the heald frame.

As already mentioned the linear motors 5 are a fixed location. In order to facilitate installation and in particular the insertion of the heald frame, a frame 11 is advantageously provided (FIG. 2). The frame 11 is rectangular and has two frame parts 12, 13 at the longitudinal sides and two frame parts 14, 15 at the broad sides which are connected together in a manner and with a means that are well known, such as integral manufacture thereof, or with bolts or screws or the like. The linear drives 5 are secured to the long sides. The heddle carrying rails 1 are so dimensioned in their length that they are freely movable by means of the armature parts 6 within the frame 11. In order to guide the heddle carrying rails 2 free of play devices 21 for the suspension are provided. Devices 21 serve as connection apparatuses for connecting the heddle carrying rails to the armature parts 6.

Figure 3:
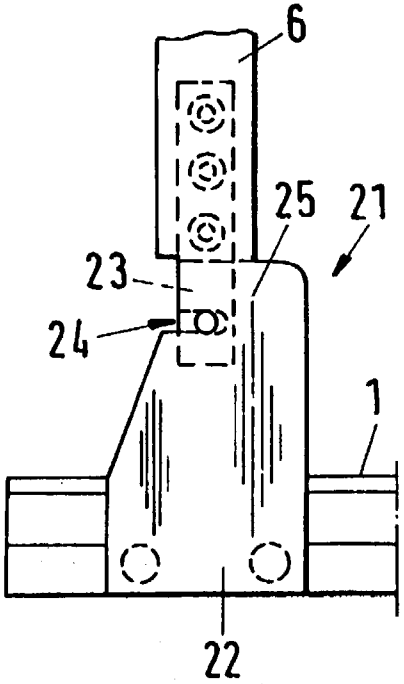
FIG. 3 is a detailed view of the portion labelled "A" in FIG. 2 on a larger scale.

As FIG. 3 shows the device 21 for the suspension comprises a plate 22 which is secured to the heddle carrying rail 1 and a holder 23 which is secured to the armature part 6. The plate 22 is provided with a slot 24 and the holder 23 has a pin 25 which engages in the slot 24. The slot 24 is so dimensioned that a compensation of the play is possible at the interface between the armature part and the heald frame in order to prevent jamming of the armature parts per heald frame. On the other hand, the slot 24 enables a compensation in the direction transverse to the working direction of the heald frame.

Figure 4:
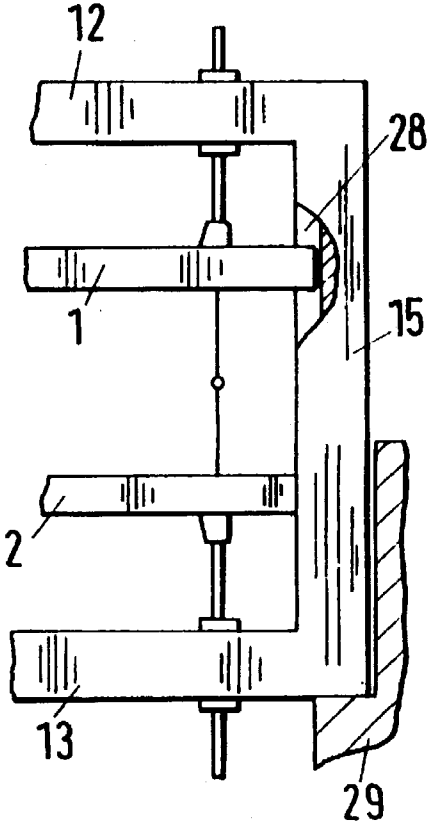
FIG. 4 is an elevation view of a portion of a second embodiment of a holding arrangement for the heald frame.

In a modified embodiment in accordance with FIG. 4, a guide groove 28 is formed in the frame and the heddle carrying rails 1, 2 are guided in the guide groove during the shed formation. In order to insert the frame, a receiving part 29 is provided in a weaving machine.

Figure 5:
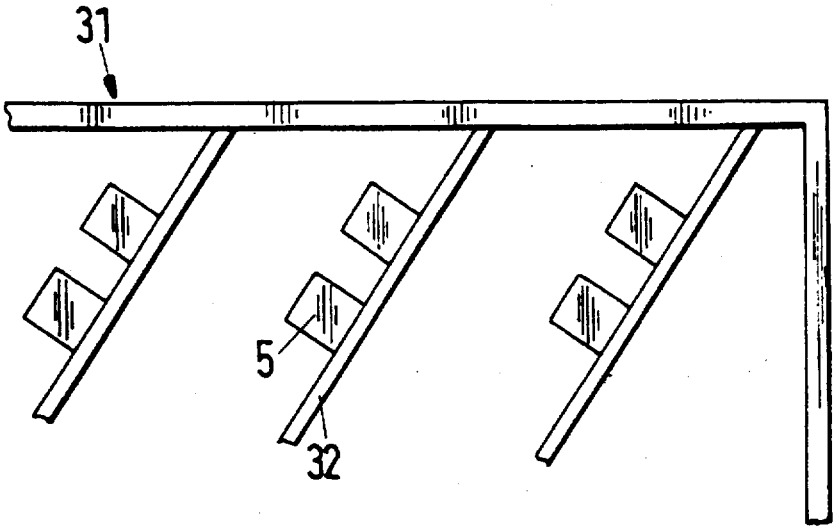
FIG. 5 is an elevation view of a portion of a third embodiment of a holding arrangement for the heald frame.

A grating 31 in accordance with FIG. 5 can be provided in place of a frame, with the linear drives 5 being respectively secured to the grid bars 32. When using grating 31 the heald frame is freely movably arranged between corresponding upper and lower grid bars. For this purpose a suitable holding device for each grating is provided in a weaving machine.

The apparatus contains a heald frame consisting of two heddle carrying rails 1, 2 and a plurality of linear drives 5 of fixed location and having armature parts 6 which are connected to the heald carrying rails 1, 2 in such a way that the heddle frame is guided free of play. Low costs and a low energy consumption result from the lightweight construction of the heddle frame.

Figure 6:
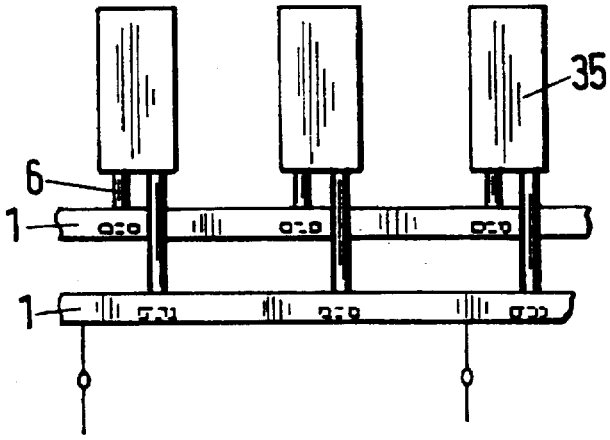
FIG. 6 is an elevation view of part of a set of shafts (harness) with a modified embodiment of the drive elements.
Figure 7:
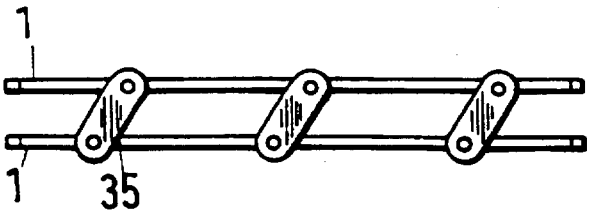
FIG. 7 is a plan view of the set of shafts illustrated in FIG. 6.

As FIGS. 6 and 7 show a constructional unit 35 with two linear motors can be used instead of a single linear motor, with the armature parts 6 being coupled to the heddle carrying rails.

In this arrangement the constructional units 35 for the lower heddle carrying rail are arranged inclined in the other direction, i.e. the linear motors are arranged crosswise with respect to the heddle frame.

What is claimed is:

1. Apparatus for forming a weaving shed comprising:

two heddle carrying rails;

a plurality of heddles for receiving and moving warp threads, the heddles being arranged between the heddle carrying rails to form a heald frame;

a plurality of linear drives each having an armature part, each linear drive being mounted to one of the heddle carrying rails via its corresponding armature part; and connection means for connecting the armature parts to the heddle carrying rails, the connection means comprising a first part connected to one of said armature parts and a second part connected to a heddle carrying rail, the connection means being configured such that the first and second parts are movable relative to one another in a direction transverse to a working direction of the heald frame.

2. The apparatus of claim 1 wherein the first part of the connection means comprises a holder and the second part of the connection means comprises a plate, the plate including a slot defined therein and the holder including a pin that engages the slot.

3. The apparatus of claim 1 further comprising a frame for said mounting of the linear drives.

4. The apparatus of claim 1 further comprising a grating for said mounting of the linear drives.

5. The apparatus of claim 1 further comprising at least two struts connected to the heddle carrying rails.

6. A weaving machine comprising an apparatus for forming a weaving shed, the apparatus comprising:

two heddle carrying rails;

a plurality of heddles for receiving and moving warp threads, the heddles being arranged between the heddle carrying rails to form a heald frame;

a plurality of linear drives each having an armature part, each linear drive being mounted to one of the heddle carrying rails via its corresponding armature part; and connection means for connecting the armature parts to the heddle carrying rails, the connection means comprising a first part connected to one of said armature parts and a second part connected to a heddle carrying rail, the connection means being configured such that the first and second parts are movable relative to one another in a direction transverse to a working direction of the heald frame;

wherein the weaving machine further comprises means for receiving a plurality of heald frames.

7. The weaving machine of claim 6 wherein the first part of the connection means comprises a holder and the second pert of the connection means comprises a plate, the plate including a slot defined therein and the holder including a pin that engages the slot.

8. The weaving machine of claim 6 wherein the apparatus further comprises a frame for said mounting of the linear drives.

9. The weaving machine of claim 6 wherein the apparatus further comprises a grating for said mounting of the linear drives.

10. The weaving machine of claim 6 wherein the apparatus further comprises at least two struts connected to the heddle carrying rails.

* * * * *